US012233301B2

(12) United States Patent
Kraan et al.

(10) Patent No.: US 12,233,301 B2
(45) Date of Patent: Feb. 25, 2025

(54) REHABILITATION DEVICE

(71) Applicant: Coloplast A/S, Humlebaek (DK)

(72) Inventors: Willem Johannes Kraan, Amstelveen (NL); Franciscus Johannes Marie Hilgers, Heemstede (NL); David Johansson, Malmö (SE)

(73) Assignee: Coloplast A/S, Humlebaek (DK)

( * ) Notice: Subject to any disclaimer, the term of this patent is extended or adjusted under 35 U.S.C. 154(b) by 153 days.

(21) Appl. No.: 17/923,232

(22) PCT Filed: May 3, 2021

(86) PCT No.: PCT/EP2021/061513
§ 371 (c)(1),
(2) Date: Nov. 4, 2022

(87) PCT Pub. No.: WO2021/224157
PCT Pub. Date: Nov. 11, 2021

(65) Prior Publication Data

US 2023/0158354 A1 May 25, 2023

(30) Foreign Application Priority Data

May 4, 2020 (SE) ..... 2050503-8
Feb. 23, 2021 (SE) ..... 2150188-7

(51) Int. Cl.
*A63B 21/00* (2006.01)
*A63B 23/025* (2006.01)

(52) U.S. Cl.
CPC .... *A63B 21/00072* (2013.01); *A63B 21/4033* (2015.10); *A63B 23/025* (2013.01)

(58) Field of Classification Search
CPC ..... A63B 21/00072; A63B 21/4033; A63B 23/025; A63B 2071/0655;
(Continued)

(56) References Cited

U.S. PATENT DOCUMENTS 3,497,217 A * 2/1970 Feather ..... A63B 23/025 482/122
5,501,646 A * 3/1996 Miller ..... A63B 23/025 482/10
(Continued)

FOREIGN PATENT DOCUMENTS

| | | |
|---|---|---|
| CN | 210409385 U | 4/2020 |
| GB | 2405108 A | 2/2005 |
| KR | 200472562 Y1 | 5/2014 |

*Primary Examiner* — Megan Anderson
*Assistant Examiner* — Andrew M Kobylarz
(74) *Attorney, Agent, or Firm* — Coloplast Corp., Coloplast A/S; Nick Baumann

(57) ABSTRACT

An exercise device (10) for swallowing rehabilitation with a variable resistance, the exercise device (10) comprising an exerciser body (20) forming a support, chin receiving means (30) movably connected to the exerciser body (20), exercising means (50) for creating resistance when the chin receiving means (30) is moved towards the exerciser body (20), and a lever arm (32, 70) connected to the exerciser body (20) via a fulcrum (45, 75) and configured to interact with the exercising means (50), wherein the exercising means (50) or the fulcrum (75) is displaceable to provide a variable resistance against movement of the chin receiving means (30) towards the exerciser body (20).

20 Claims, 9 Drawing Sheets

(58) Field of Classification Search
CPC ..... A63B 21/00058; A63B 21/0428; A63B 2225/09; A63B 21/023; A63B 21/4045; A63B 23/03
See application file for complete search history.

(56) References Cited

U.S. PATENT DOCUMENTS

| | | | | |
|---|---|---|---|---|
| 5,971,890 | A | 10/1999 | Tyne | |
| 6,171,214 | B1 * | 1/2001 | Lundin | A63B 21/4047 482/121 |
| D949,988 | S | 4/2022 | Younane | |
| 2012/0047656 | A1 * | 3/2012 | Benton | A47C 7/383 5/640 |
| 2014/0325741 | A1 | 11/2014 | Zaouk et al. | |
| 2017/0258663 | A1 | 9/2017 | Parker et al. | |

* cited by examiner

REHABILITATION DEVICE

FIELD OF THE INVENTION

This invention pertains in general to a rehabilitation device. More particularly, the present invention pertains to an exercise device for swallowing rehabilitation, e.g. to use for swallow exercises and for jaw exercises.

BACKGROUND OF THE INVENTION

Swallowing is a complex action involving muscles and nerves within oral cavity, pharynx and esophagus, as well as a swallowing centre in the brain that is connected to the pharynx and esophagus by nerves.

Dysphagia is dysfunction of the swallowing and is in general terms described as an inability to move food, or liquid, from the mouth to the stomach. Dysphagia is a symptom of many different causes and may result from congenital abnormalities, structural damage, and/or medical conditions. For example, it may occur after head and neck cancer (HNC) treatment. Dysphagia may also occur after total laryngectomy as muscles involved in swallowing are removed or transected.

The impact on the quality of life for dysphagia patients may be substantial. For example, subjects suffering from dysphagia may be affected by chronic malnutrition, dehydration, failure to thrive, aspiration pneumonia, and exacerbation of chronic lung disease.

There are many ways to treat dysphagia and conventional therapies for dysphagia generally include dietary modification, compensatory techniques like postural alterations, indirect therapy like strengthening exercises for swallowing muscles, direct therapy like exercises during swallowing and medical therapy. The aim of the treatment is to maintain adequate nutritional and hydrational intake and to maximize airway protection. With strengthening therapy, the swallowing muscles may be exercised and the swallowing function improved. This may result in that feeding tube dependency and diet modification may be reduced. Additionally, the risk of aspiration pneumoniae and trismus may be reduced. By reducing the listed issues, a higher quality of life may be achieved.

However, there are problems associated with current strengthening therapy. There currently does not exist any exercise device, or rehabilitation device, that is suitable for persons that have undergone a total laryngectomy. Traditionally, dysphagia for these persons has mainly been treated by surgical methods, pharmacological methods and coping strategies. For this reason, existing exercise devices do not target all of the necessary muscles for persons that have undergone total laryngectomy. Additionally, as existing exercising devices are not intended for persons that have undergone total laryngectomy, these exercise devices are not suitable for a user having tracheostoma. Existing exercise devices may cover the tracheostoma and/or make breathing difficult during use of the exercise device.

Furthermore, there currently does not exist any exercise devices, or rehabilitation devices, that is possible to use for different exercises. In order to exercise different muscles, different exercise devices have to be used. Thus, a user needs to have several different rehabilitation devices for different purposes. In addition to this, existing exercise devices generally also have the drawback that the resistance used for training is unknown and that the resistance is not possible to vary. The lack of knowledge of the used resistance and the possibility to vary the resistance is also a problem for exercises that do not need an exercise device at all. These exercises usually also have the disadvantages that they often are performed in unfeasible positions, such as laying down etc.

Hence, an improved exercise device would be advantageous, and in particular, an exercise device allowing for increased user comfort, which is possible to use for different exercises and which additionally also is suitable for a person that has undergone total laryngectomy.

SUMMARY OF THE INVENTION

Accordingly, the present invention preferably seeks to mitigate, alleviate or eliminate one or more of the above-identified deficiencies and disadvantages, singly or in any combination, and solves at least the above-mentioned problems by providing an exercise device for swallowing rehabilitation. Said exercise device comprises a curved exerciser body forming a support and holding means mounted to said exerciser body. The exercise device further comprises chin receiving means movably connected to said holding means and exercising means for creating resistance when the chin receiving means is moved towards the exerciser body. The exercising means is configured to extend between said exerciser body and said chin receiving means.

According to an aspect, there is provided an exercise device for swallowing rehabilitation with a variable resistance, the exercise device comprising an exerciser body forming a support, chin receiving means movably connected to the exerciser body, exercising means for creating resistance when the chin receiving means is moved towards the exerciser body, and a lever arm connected to the exerciser body via a fulcrum and configured to interact with the exercising means, wherein the exercising means or the fulcrum is displaceable to provide a variable resistance against movement of the chin receiving means towards the exerciser body.

Optionally, the exerciser body comprises a chest resting plate adapted to engage with a chest of a user of the exercise device. Optionally, the at least a part of the chest resting plate is provided with a padding.

Optionally, the chin receiving means comprises a chin receiving plate for receiving a chin of a user of the exercise device. Optionally, the at least a part of the chin receiving plate is provided with a padding.

Optionally, the exercising means comprises a spring or an elastomer member. Optionally, the exercising means is slidable along the exerciser body to provide the variable resistance. Optionally, the exercising means is arranged to extend between the exerciser body and the lever arm.

Optionally, one end of the exercising means is connected to the exerciser body with an attachment device. Optionally, one end of the exercising means is connected to the lever arm with an attachment device. Optionally, the exercising means is detachably attached to the exerciser body and/or the chin receiving means with the attachment device, thereby making the exercising means replaceable. Optionally, a length of the exercising means is adjustable by the attachment device to provide the variable resistance.

Optionally, the exercise device further comprises a holding means comprising an elongated member, wherein the elongated member is secured to the exerciser body at one end and configured to receive the lever arm at the other end. Optionally, the lever arm is pivotally connected to the elongated member by the fulcrum, around which the lever arm is pivotal.

Optionally, the exercise device further comprises a handle, wherein the handle is attached to the respective ends of the exerciser body, thereby forming a closed loop with the exerciser body.

Optionally, the fulcrum is displaceable to provide the variable resistance. Optionally, the fulcrum is displaceable to adjust a lever ratio of the lever arm. Optionally, the fulcrum is displaceable between a number of pivot positions. Optionally, the number of pivot positions are defined by a rack of the lever arm.

Optionally, the exercise device further comprises a holding means secured to the exerciser body, wherein the holding means is configured to receive the lever arm. Optionally, the lever arm is coupled to the holding means via the fulcrum.

Optionally, the exercising means is disposed between the exerciser body and the adjustment lever. Optionally, the exercise device further comprises a handle disposed between the exerciser body and the adjustment lever, wherein the exercising means is disposed inside the handle.

Optionally, the lever arm comprises an elongate member having a first end and a second end, wherein the lever arm is connected to the exercising means at the first end and is configured to interact with the chin receiving means at the second end. Optionally, the chin receiving means comprises a connection member pivotal around a fulcrum/pin. Optionally, the connection member comprises a first arm configured to interact with the lever arm, and a pair of second arms configured to receive the lever arm between them when the lever arm pivots about the fulcrum. Optionally, the lever arm is configured to interact with the chin receiving means via a roller. Optionally, the lever arm is connected to the exercising means via a loading arrangement, and the loading arrangement is configured to compress the exercising means when the lever arm pivots about the fulcrum. Optionally, the loading arrangement comprises a connecting element and a stop, wherein the connecting element has a first end connected to the lever arm and a second end connected to the stop, the exercising means is disposed between the lever arm and the stop, and the stop configured to compress the exercising means when the lever arm pivots about the fulcrum by movement of the connecting element.

Also disclosed herein is an exercise device for swallowing rehabilitation with a variable resistance, the exercise device comprising an exerciser body forming a support, a chin receiving means movably connected to the exerciser body, exercising means for creating resistance when the chin receiving means is moved towards the exerciser body, and a lever arm connected to the exerciser body via a fulcrum and configured to interact with the exercising means, wherein the exercising means is displaceable to provide a variable resistance against movement of the chin receiving means towards the exerciser body.

Also disclosed herein is an exercise device for swallowing rehabilitation with a variable resistance, the exercise device comprising an exerciser body forming a support, chin receiving means movably connected to the exerciser body, exercising means for creating resistance when the chin receiving means is moved towards the exerciser body; and a lever arm connected to the exerciser body via a fulcrum and configured to interact with the exercising means, wherein the fulcrum is displaceable to provide a variable resistance against movement of the chin receiving means towards the exerciser body.

Thereby, an exercise device for adjustable swallowing rehabilitation, which is possible to use for a plurality of exercises, and with a variable resistance, is provided. The provided exercise device additionally provides an increased user comfort.

BRIEF DESCRIPTION OF THE DRAWINGS

These and other aspects, features and advantages of which the invention is capable of will be apparent and elucidated from the following description of embodiments of the present invention, reference being made to the accompanying drawings, in which.

DESCRIPTION OF THE EMBODIMENTS

The following description focuses on an embodiment of the present invention applicable to an exercise device and in particular to an exercise device for swallowing rehabilitation. However, it may be appreciated that the exercise device is suitable also for other purposes than swallowing rehabilitation. Examples of such purposes may be voice training, general jaw training, swallowing training, and other dysphagia conditions.

Figure 1A:
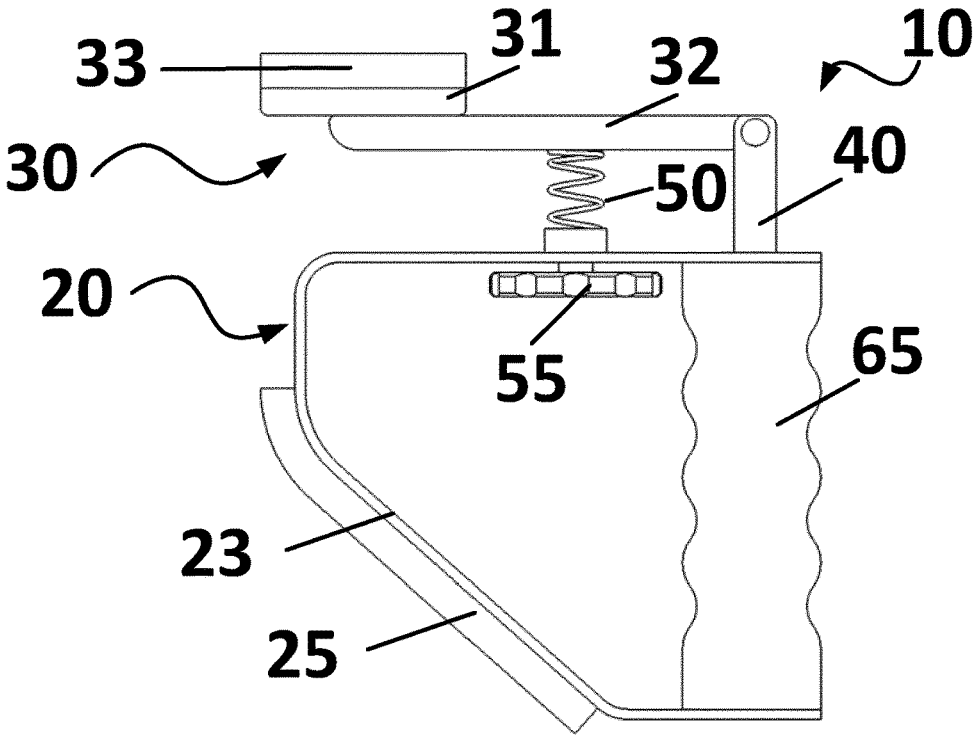
FIG. 1*a* is a side view of an exercise device according to an embodiment of the present invention.

FIG. 1*a* shows a side view of an exercise device 10 for swallowing rehabilitation according to a first embodiment of the present disclosure. Swallowing rehabilitation may include, for example, performing swallow exercises or other jaw exercises. As illustrated in FIG. 1*a*, the exercise device 10 comprises an exerciser body 20 forming a support. The exercise body 20 is curved and is adapted to engage with a user using said exercise device 10. In some embodiments, the exercise body 20 may comprise a chest resting plate 23 adapted to engage with a chest of a user using the exercise device 10. Thus, when the exerciser device 10 is in use, the chest resting plate 23 of the exerciser body 20 may rest against the chest of the user. At least a part of the chest resting plate 23 may be provided with a padding 25. The padding 25 may be of a softer material than the exerciser body 20 and may thus be more comfortable to have against the chest than the rest of the exerciser body 20. This may improve the user comfort. The padding 25 may be, for example, a foam padding.

The exercise device 10 further comprises holding means 40 mounted to the exercise body 20. As seen in FIG. 1*a*, the holding means 40 is extending from the exercise body 10. The holding means 40 is configured to hold a chin receiving means 30. The exercise device 10 comprises the chin receiving means 30 and the chin receiving means 30 is movably connected to the holding means 40. The holding means 40 secures the chin receiving means 30 to the exercise device 10 in a way such that the chin receiving means 30 is movable relative the exercise device 10. The chin receiving means 30 is adapted to engage with a chin, or a jaw, of a user using the exercise device 10. As illustrated in FIG. 1*a*, the chin receiving means 30 may comprise a chin receiving plate 31 for receiving a chin of a user using the exercise device 10. The chin receiving means 30 may further comprise a connection member 32 for movably connecting said chin receiving plate 31 to said holding means 40. In some embodiments, at least a part of the chin receiving plate 31 of the chin receiving means 30 may be provided with a padding 33. The padding 33 may be of a softer material than the rest of the chin receiving means 30 and may thus improve the user comfort. The padding 33 may be, for example, a foam padding.

Figure 1B:
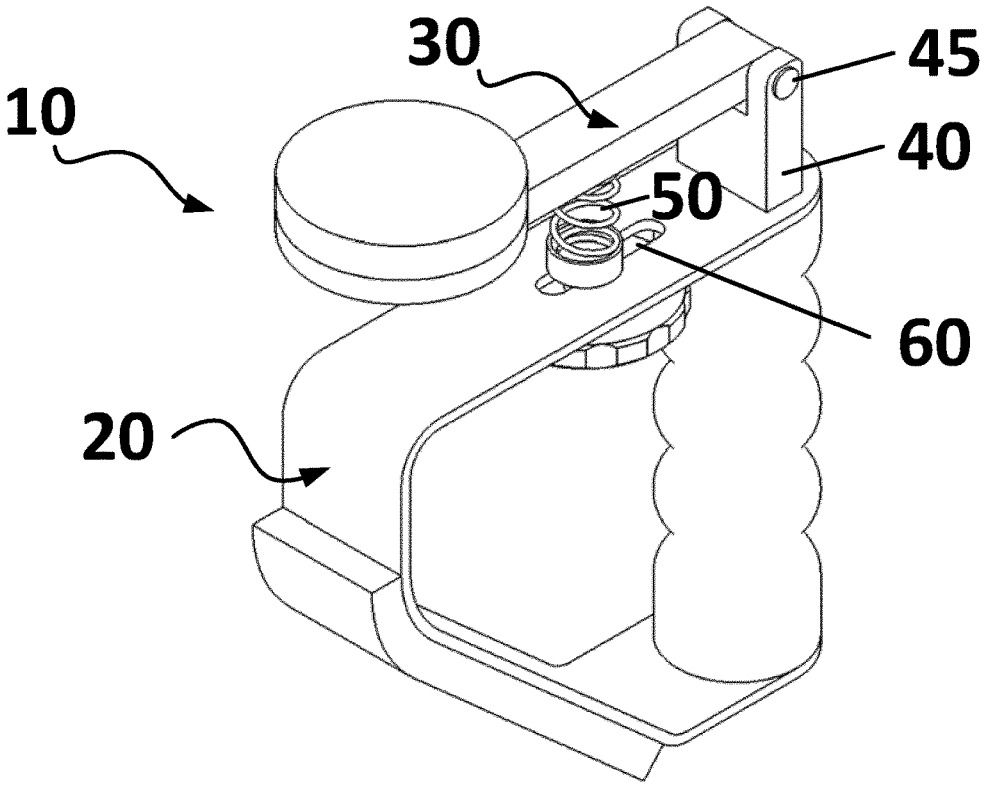
FIG. 1*b* is a perspective view of an exercise device according to an embodiment of the present invention.

The holding means 40 may be realized in different ways and FIGS. 1*a* and 1*b* illustrate one example embodiment. The holding means 40, according to this example embodiment, comprises an elongated member. The elongated member extends in an upward direction from the exerciser body 20. The elongated member is secured to the exerciser body 20 at one end and is configured to receive the chin receiving means 30 at the other end. Thus, the holding means 40 is firmly mounted to the exerciser body 20 at one end. The chin receiving means 30 received at the other end may be received such that it is pivotally attached to the elongated member, i.e. the chin receiving means 30 is movably connected to the holding means 40. As illustrated in FIG. 1*b*, the chin receiving means 30 may be pivotally connected to said elongated member by at least one pin 45, or joint. The chin receiving means 30 is pivotal around said at least one pin 45.

The exercise device 10 further comprises exercising means 50 for creating resistance when the chin receiving means 30 is moved towards the exerciser body 10, i.e. for creating a resistance to a user using the exercise device 10. The exercising means 50 is arranged to extend between said exerciser body 20 and said chin receiving means 30. According to the embodiment illustrated in FIG. 1*a*, one end of the exercising means 50 is fixed to the exerciser body 20 by an attachment device 55. The other end of the exercising means 20 may be connected to the chin receiving means 30, but without being attached with any fastening means. The chin receiving means 30 is adapted to rest at this other end of the exercising means 50. Thus, in the embodiment illustrated in FIG. 1*a*, the exercising means 50 is not securely fixed to the chin receiving means 30. The exercising means 50 and the chin receiving means 30 are only connected to each other by the physical contact that arises when they touch each other, but without being physically attached with any fastening means. It may thus be possible to lift the chin receiving means 30 in an upwards direction away from the exercising means 50 such that the exercising means 50 and the chin receiving means 30 are no longer connected to each other. It may be realized that according to another embodiment, the exercising means 50 may be securely fixed to the chin receiving means 30 by an attachment device, but not fixed to the exerciser body 20. In still another embodiment, the exercising means 50 may be securely fixed at both ends, to both the exerciser body 20 and the chin receiving means 30.

In some embodiments, the exercising means 50 may be detachably attached to the exerciser body and/or the chin receiving means 30 with the attachment device 55, thereby making the exercising means 50 replaceable. This makes it possible to replace, or exchange, the exercising means 50 by another exercising means 50. This may be usable in case the exercising means 50 breaks. This may also be used for changing the load, or the resistance, created by said exercising means 50. For example, if a user finds an exercising means 50 with a certain stiffness or resistance too easy to exercise with, the exercising means 50 may be replaced by another exercising means 50, which has another, higher, stiffness, or resistance. Thereby an amount of resistance created by said exercising means 50 may be changed. By changing the resistance, or the load, of the exercise device 10, a user using the exercise device 10 may continue exercising at 60-70% of maximum capacity. This may ensure that the user's strength will continue to increase.

In some embodiments, the exercising means 50 may be adjustably attached to the exerciser body and/or the chin receiving means 30 with the attachment device 55. In such embodiments, the attachment device 55 may be disposed in an elongate slot 60, as illustrated in FIG. 1*b*. The attachment device 55 is slidable along the length of the elongate slot 60. As such, the position of the exercising means 50 relative to the holding means 40 and the at least one pin 45 is adjustable. By adjusting the position of the exercising means 50 relative to the holding means 40 and the at least one pin 45, the resistance may be changed. In such embodiments, the exercising means 50 and the chin receiving means 30 are only connected to each other by the physical contact that arises when they touch each other, but without being physically attached with any fastening means. According to another embodiment, the exercising means 50 may be adjustably attached to the chin receiving means 30 by an attachment device 55, with a corresponding elongate slot 60 present in the connection member 32, but not fixed to the exerciser body 20. In still another embodiment, the exercising means 50 may be adjustably attached at both ends, to both the exerciser body 20 and the chin receiving means 30.

According to the previously described embodiment, the load of the exercising device 10 may be changed by exchanging, or replacing, the exercising means 50. According to another embodiment, a length of the exercising means 50 for creating resistance may be adjustable by the attachment device 55 with which the exercising means 50 is attached. Thereby, an amount of resistance created by said exercising means 50 may be changed. The length of the exercising means 50 may also be adjusted in order to adjust the height of the exercise device 10, such that it is more suitably adapted to the user using the exercise device 10.

The exercising means 50 may comprise, for example, a spring. An example of such embodiment is illustrated in FIGS. 1*a* and 1*b*. As seen in FIGS. 1*a* and 1*b*, the spring is secured at one end to the exerciser body 20 with the attachment device 55. The chin receiving means 30 is resting at the other end of the spring. As is known, different springs may have different spring constants. Different spring constants cause different stiffness and thereby causes different resistances. Thereby, by choosing a spring with a certain spring constant, i.e. stiffness, the resistance of the exercise device 10 may be regulated.

According to another embodiment, the exercising means 50 may comprise an elastomer member such as a silicone block. Depending on the size, shape, stiffness and density of the elastomer member, the resistance of the exercise device 10 may be regulated.

The exercise device 10 according to the present disclosure achieves an increased user comfort. The construction of the exercise device 10 makes it possible for a user to perform swallowing rehabilitation in comfortable positions, e.g. in an upright position. Thus, the user does not have to lay down in order to perform the exercises. Additionally, the provided exercise device 10 comprises a construction with an exerciser body 20, which does not cover a tracheostoma when it is in use. This makes it easy to breathe when using the exercise device 10 and makes the provided exercise device 10 suitable for users having undergone a total laryngectomy. In some embodiments, in order to improve the user comfort for a user with a tracheostoma even further, the exercise device 10 may additionally comprise an opening, for example a hole or a fork in the exerciser body 20. The opening makes it possible for air to freely flow through the hole of the exerciser body 20 in and out from the tracheostoma.

Furthermore, with the chin receiving means 30, which is movable relative the exerciser body 20, the user may receive tactile feedback while performing swallowing rehabilitation. By receiving direct feedback while performing swallowing rehabilitation, the user experience may be improved, which may motivate the user to continue using the exercise device 10.

In some embodiments, the exercise device 10 may further comprise a handle 65. The handle 65 may be attached to the respective ends of the curved exerciser body 20. By providing a handle that connects the exterior ends of the exerciser body 20, the exerciser body 20 and the handle 65 form a closed loop and thus provide a solid and secure construction of the exercise device 10. With a handle 65 that a user may grip during use of the exercise device 10, the exercise device 10 may also be easier to operate and to hold in the right position during exercise.

Figure 2A:
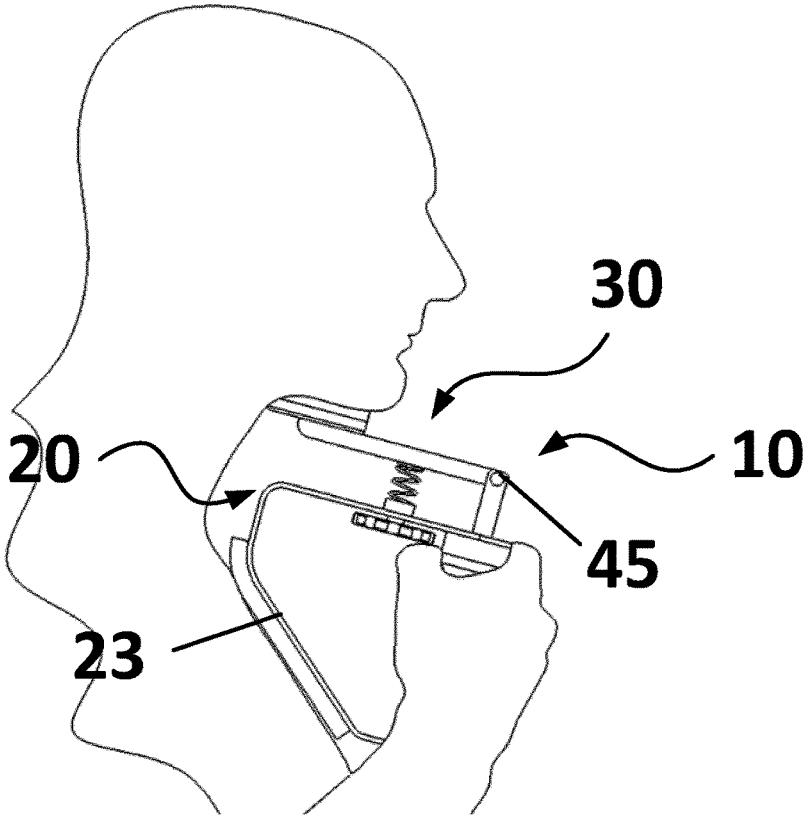
FIG. 2*a* illustrates an exercise device according to an embodiment of the present invention in use.

FIG. 2*a* illustrates the exercise device 10 in use. In FIG. 2*a*, the user holds the exerciser device 10 in a start position, i.e. before any swallowing rehabilitation has begun. The exercise device 10 according to this embodiment comprises a handle 65 that the user holds during the use. As seen in the figure, the chest resting plate 23 of the exerciser body 20 rests against the chest of the user and the user's chin is resting on the chin receiving plate 31 in the start position.

One of the advantages with the exercise device 10 presented herein is that the exercise device 10 may be used for a plurality of different exercises. The exercises start from the previously described start position and from this position the plurality of different exercises may be performed. Some of these exercises will now be described with reference to FIG. 2*b*-2*d*.

Figure 2B:
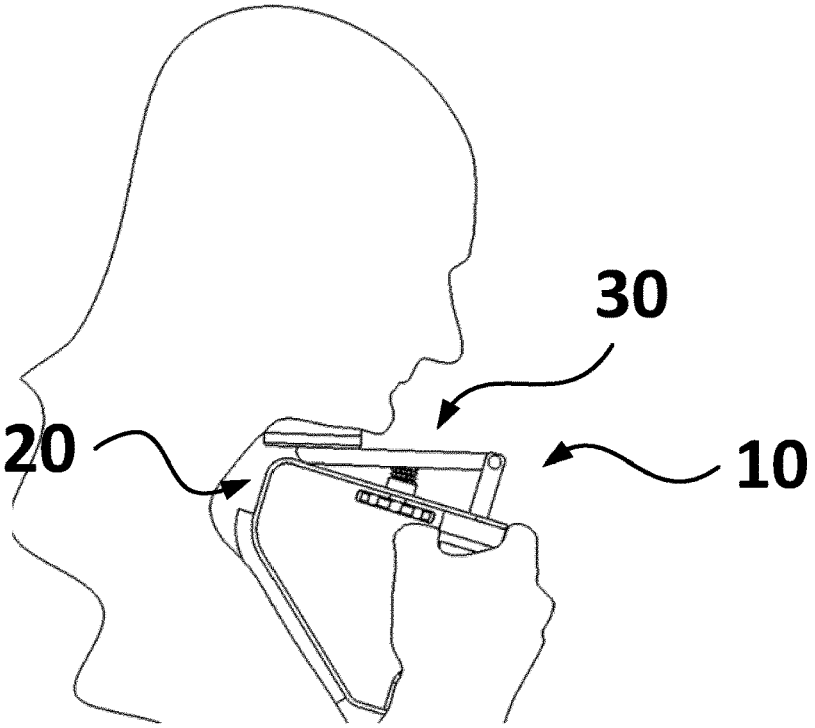
FIG. 2*b* illustrates an exercise device according to an embodiment of the present invention in use.

FIG. 2*b* shows a user performing an exercise herein referred to as "chin tuck against resistance". The exercise is performed by pressing the chin downwards, towards the chest of the user, using the exercise device 10. The chin rests at the chin receiving means 30. When the user presses their chin downwards, the chin receiving means 30 pivots around the pin 45 and chin receiving means 30 is moved towards the exerciser body 20. The final position, when the chest receiving means 30 is completely pushed towards the exerciser body 20, is shown in FIG. 2*b*. The exercising means 50 creates a resistance so that the user has to use a force to push the chin receiving means 30 downwards. The purpose of this exercise is to strengthen muscles that pull the larynx and hyoid up and forward, and improve the ability to swallow. The chin tuck exercise targets the same muscles as the generally known "shaker exercises", also referred to as "head-lifting exercises". In these exercises, a user rests in a supine position and lifts the head to look at the toes. Compared to the shaker exercises, the chin tuck exercise, performed with the exercise device 10, may be performed in a much more comfortable position, e.g. in an upright position. Additionally, with a replaceable or adjustable exercising means 50, the load that the user is exposed to may be known and adjustable.

Figure 2C:
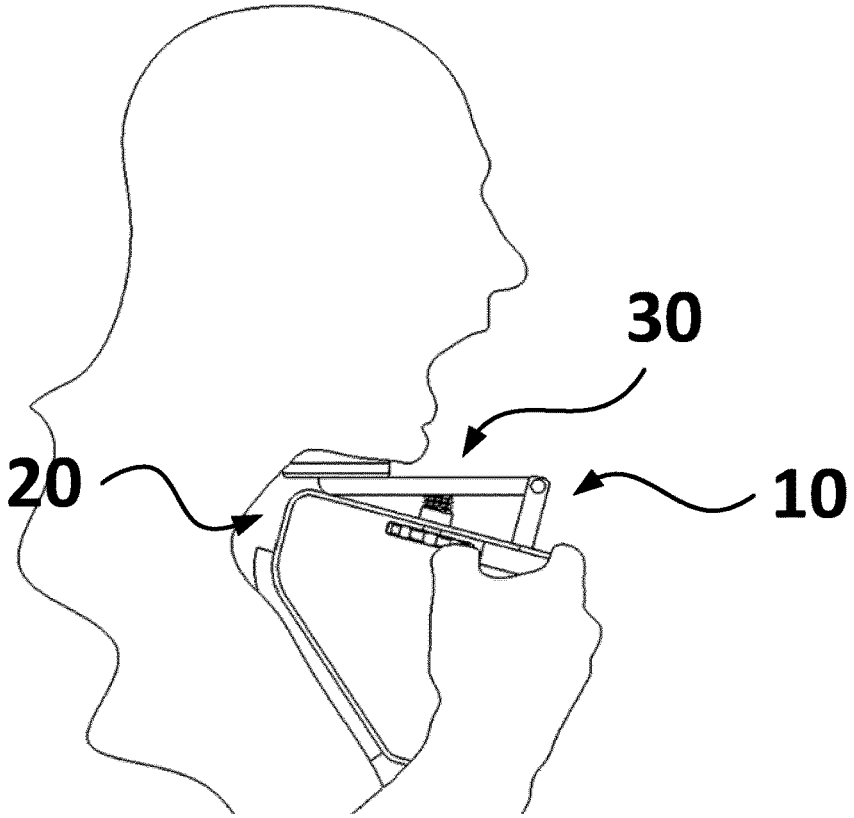
FIG. 2*c* illustrates an exercise device according to an embodiment of the present invention in use.

Another exercise, which may be performed with the exercise device 10, is illustrated in FIG. 2*c*. FIG. 2*c* shows an exercise herein referred to as "jaw opening against resistance". The exercise is performed by pressing the lower jaw downwards, towards the exerciser body 20 of the exercise device 10. The chin rests at the chin receiving means 30. When the user opens the mouth and presses the lower jaw downwards, the chin receiving means 30 pivots around the pin 45 and chin receiving means 30 is moved towards the exerciser body 20. The exercising means 50 creates a resistance so that the user has to use a force to push the chin receiving means 30 downwards with the lower jaw. FIG. 2*c* shows the final position of the jaw opening exercise, i.e. when the lower jaw has pushed the chin receiving means 30 all the way down to the exerciser body 20. The jaw opening exercise targets the same muscles as the generally known "Masako exercise". The intent is to improve movement and strength of the posterior pharyngeal wall during swallowing. The exercise may also improve tongue base movement and improve the muscular pressures generated on foods and liquids during swallowing.

Figure 2D:
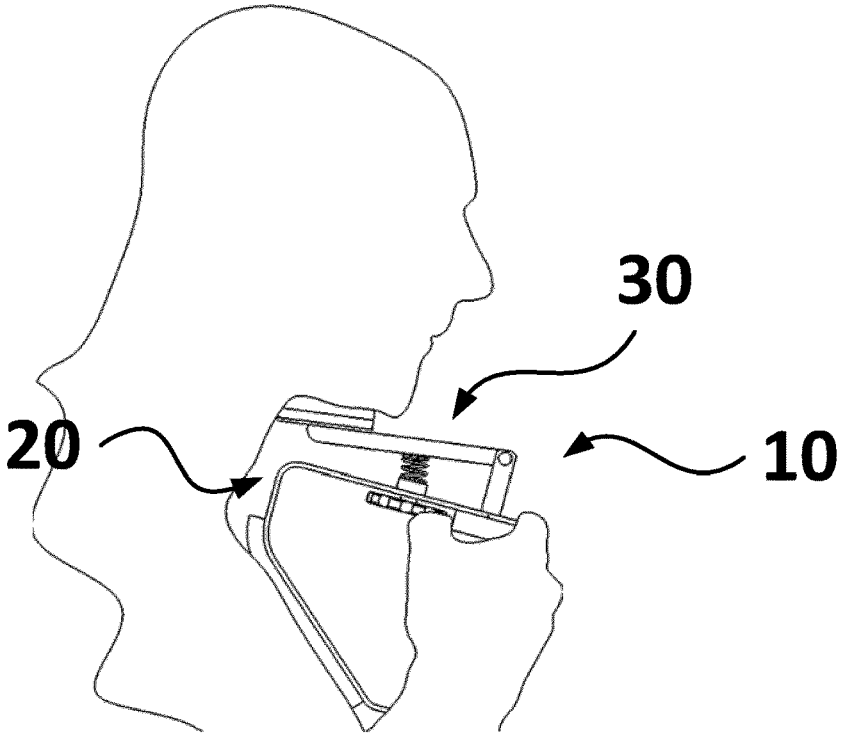
FIG. 2*d* illustrates an exercise device according to an embodiment of the present invention in use.

Still another exercise, which may be performed with the exercise device 10, is illustrated in FIG. 2*d*. FIG. 2*d* shows an exercise, which may be referred to as "effortful swallow". The exercise increases tongue base retraction and pharyngeal pressure during the swallow for reduced residue in the valleculae. The aim of the exercise is to improve the contact and coordination between the different muscles used while swallowing. As seen in FIG. 2*d*, the exercise is performed by pressing the chin at the chin receiving means 30 and then swallowing.

Taken together, the three previously described exercises may target suprahyoid and infrahyoid muscles—for larynx elevation, sternocleidomastoid muscle and lateral pterygoid—mouth opening and trismus prevention-treatment. Thus, by using the provided exercise device 10, the anterior tongue strength may be increased, the maximum mouth opening may be increased, and volume and strength of muscles may be increased. Thus, the provided exercise device 10 targets all the muscles that may be trained by a person that has undergone a total laryngectomy. Additionally, as the load of the exercising means 50 may be known, it is possible to choose an exercise device 10 with a suitable load for a certain user and potentially also increase the load as the muscles become stronger.

Figure 3A:
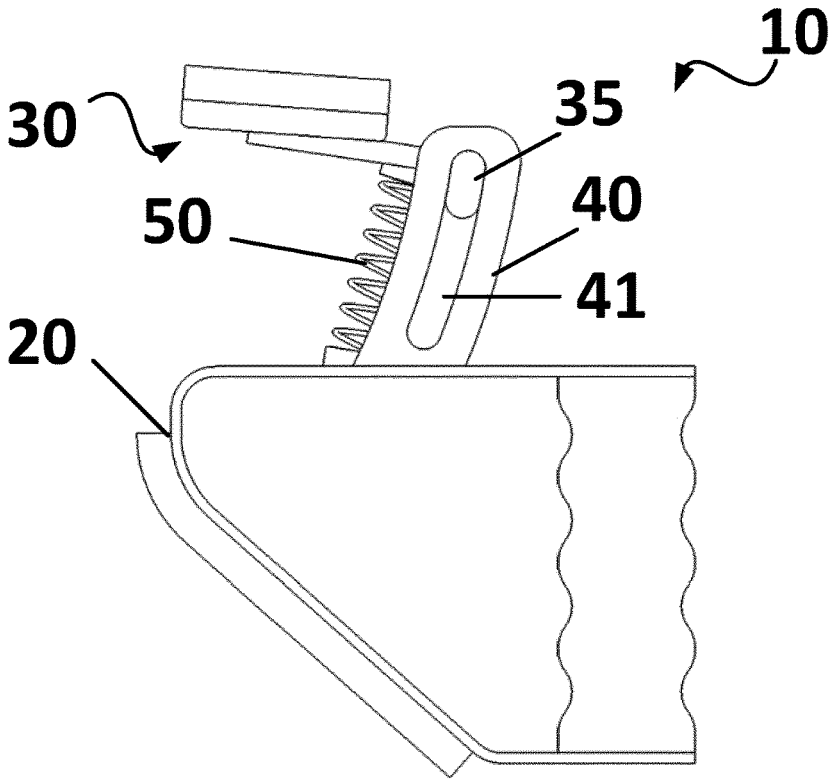
FIG. 3*a* is a side view of an exercise device according to an embodiment of the present invention.
Figure 3B:
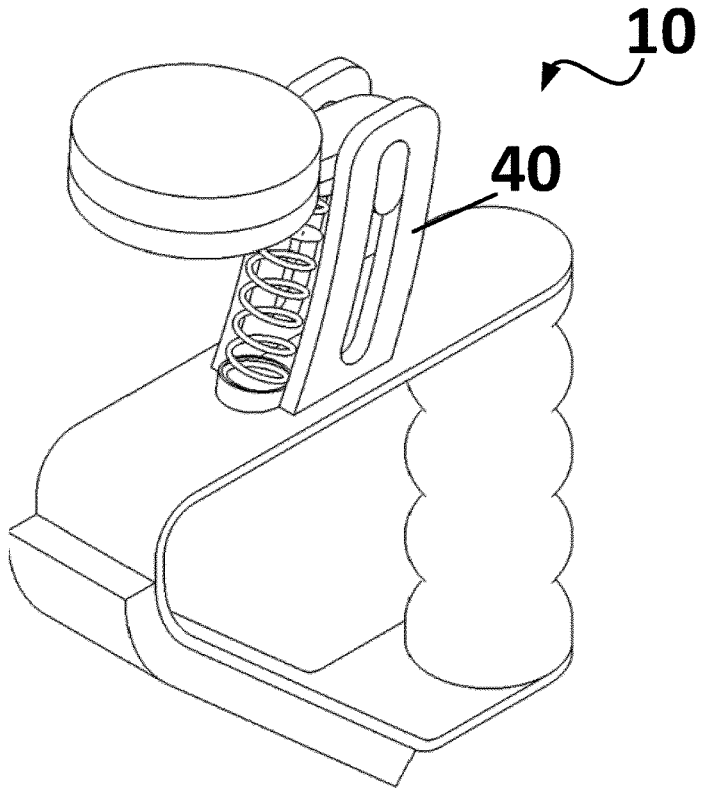
FIG. 3*b* is a perspective view of an exercise device according to an embodiment of the present invention.

Another embodiment of the present disclosure will now be described with reference to FIG. 3*a*. The exercise device 10 according to this embodiment is embodied in a corresponding way as the ones illustrated in the previous figures, but with a different construction of the holding means 40. As illustrated in FIG. 3*a*, the holding means 40 of the exercise device 10 comprises two slightly curved members. The two curved members are secured to the exerciser body 20 at one end. They extend in a direction away from the exerciser body 20. Each of the two curved members comprises a guide track 41 configured to receive the chin receiving means 30. FIG. 3*b* is a perspective view of the exercise device 10 according to this embodiment. As seen in FIG. 3*b*, the holding means 40 comprises two curved members firmly mounted to the exerciser body 20 at one end. The chin receiving means 30 is movably connected to the curved members, such that the chin receiving means 30 may move within the guide tracks 41. In some embodiments, the chin receiving means 30 may comprise two engaging means 35. The engaging means 35 may be radially extending from the chin receiving means 30 and configured to engage with the guide tracks of the holding means 40 such that the engaging means 35 is kept within the guide track during movement of the chin receiving means 30.

Figure 4:
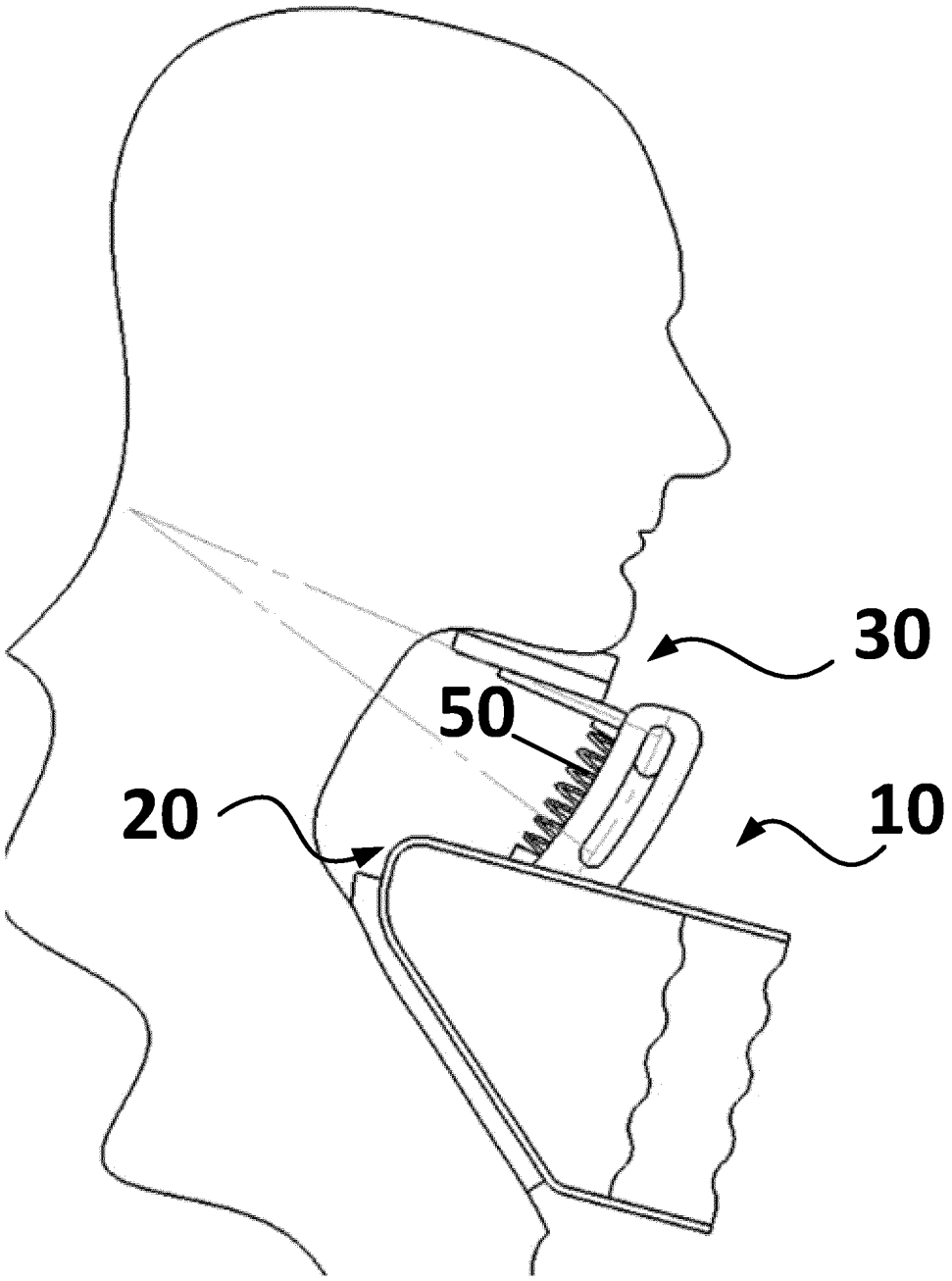
FIG. 4 illustrates an exercise device according to an embodiment of the present invention in use.

FIG. 4 illustrates the previously described embodiment in use. As understood from FIG. 4, when the user pushes their chin downwards, i.e. towards the chest, the chin receiving means 30 will slide inside the guide tracks towards the exerciser body 20. While the chin receiving means 30 is pushed downwards, the exercising means 50 will create a resistance acting towards the chin receiving means 30, forcing the user to push harder. As seen in FIG. 4, the chin receiving means 30 will pivot around a center located at the neck of the user using the exercise device 10. The described embodiment provides a solid and sustainable construction of the exercise device 10.

Figure 5A:
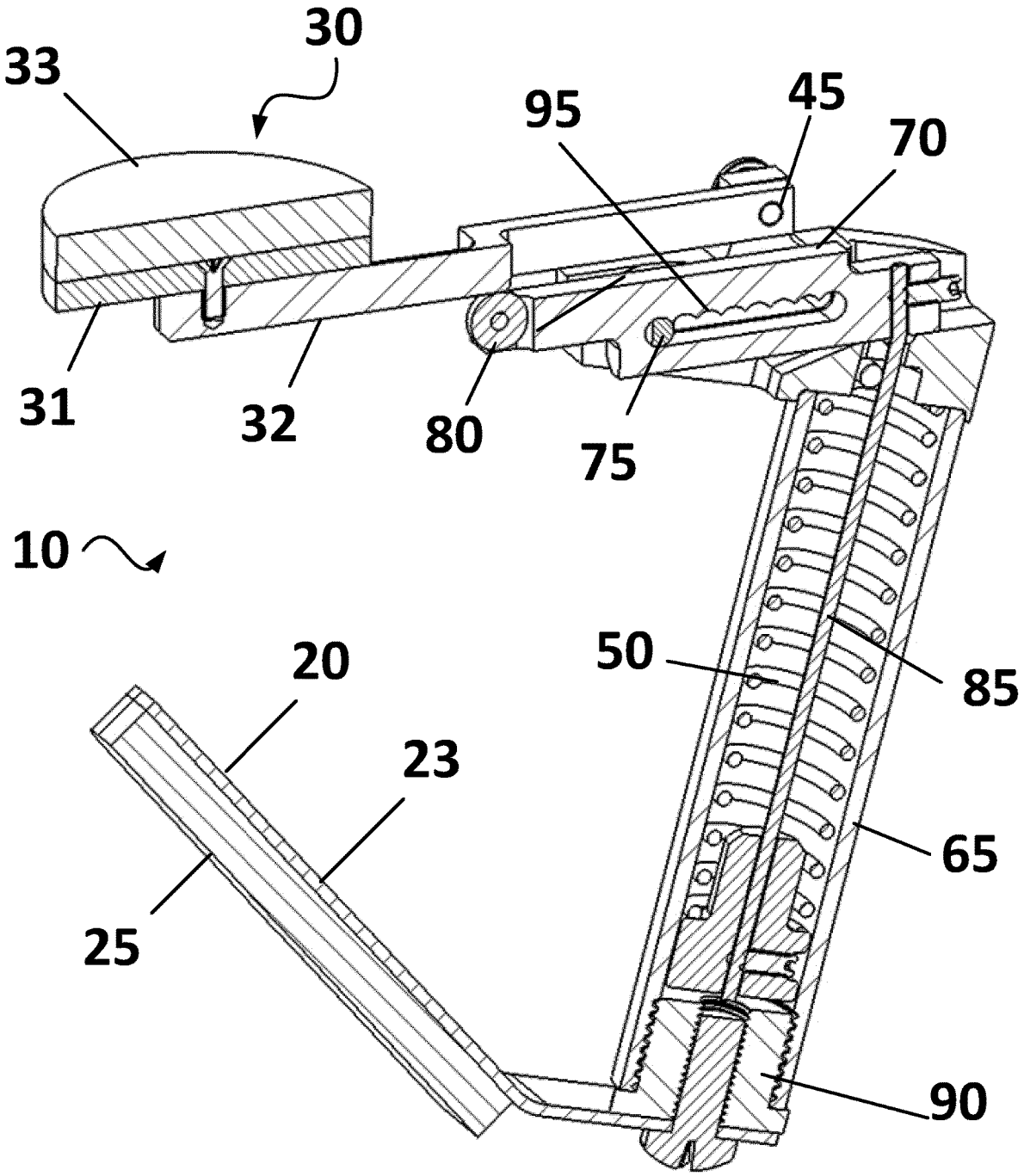
FIG. 5*a* is a perspective cross-sectional view of an exercise device according to an embodiment of the present invention.

FIG. 5*a* shows a cross-sectional view of an exercise device 10 for swallowing rehabilitation according to a third embodiment of the present disclosure. The exercise device 10 shown in FIG. 5*a* comprises an adjustment lever 70 that allows adjustment of a resistance against movement of a chin receiving means.

As illustrated in FIG. 5*a*, the exercise device 10 comprises an exerciser body 20 for supporting the device 10 during use. The exerciser body 20 may have a chest resting plate 23 adapted to engage with a chest of a user using the exercise device 10. The chest resting plate 23 may have a padding (not shown), such as the padding 25 shown in FIG. 1.

The exercise device 10 also comprises a chin receiving means 30 movably connected to the exerciser body 20. The chin receiving means 30 comprises a chin resting plate 31 and padding (not shown), such as the padding 33 shown in FIG. 1. The chin receiving means 30 also comprises a connection member 32 connected to the exerciser body 20. In the embodiment of FIG. 5*a*, the chin receiving means 30 is connected to the exerciser body 20 via a holding means 40 (shown in FIG. 5*b*) and a pin 45. The chin receiving means 30 is pivotable about the pin 45.

The exercise device 10 also comprises an adjustment lever 70. The adjustment lever 70 comprises an elongate member that is pivotable about an adjustment pin 75. The adjustment lever 70 is connected to the exerciser body 20 via the holding means 40 and the adjustment pin 75. The adjustment lever 70 comprises a roller 80 at one end that is in contact with a lower surface of the connection member 32 of the chin receiving means 30. In operation, the chin receiving means 30 interacts with the roller 80 such that the adjustment lever 70 is pivoted about the adjustment pin 75 when the chin receiving means 30 is moved towards the exerciser body 20.

In the embodiment of FIG. 5*a*, an exercising means 50 is disposed between the exerciser body 20 and the adjustment lever 70. The exercising means 50 may be a compression spring, similar to those used in the previously described embodiments, or an elastomer member such as a silicone block. As shown FIG. 5*a*, in some embodiments the exercising means 50 is disposed inside a handle 65 of the exercise device 10.

A loading arrangement is provided to connect the adjustment lever 70 to the exercising means 50. The loading arrangement may comprise a connecting element 85, for example a wire or cable, connected to the adjustment lever 70 at the opposite end of the adjustment lever 70 to the roller 80. The loading arrangement may also comprise a stop 90, for example a spring washer, connected to the other end of the connecting element 85. The exercising means 50 is disposed between the lever arm 70 and the stop 90. For example, the connecting element 85 may run through an axis of the exercising means 50. The adjustment lever 70, the connecting element 85 and the stop 90 are operable to compress the exercising means 50 during operation of the device 10, as will be discussed in relation to FIG. 5*c*.

The exercise device 10 shown in FIG. 5*a* provides for adjustable or variable resistance against movement of the chin receiving means 30 towards the exerciser body 20. To achieve this, the pivot position of the adjustment lever 70 is adjustable. As shown in FIG. 5*a*, the adjustment lever 70 comprises a rack 95 configured to receive the adjustment pin 75. The rack 95 comprises a number of adjacent positions for receiving the adjustment pin 75, which define different pivot positions for the adjustment lever 70. The adjustment pin 75 is placed in one of the positions in the rack 95, and provides a pivot for the adjustment lever 70 about that position. As such, the pivot position is adjustable along the length of the adjustment lever 70 by movement the adjustment pin 75 between the positions in the rack 95. It will be appreciated that the pivot position of the adjustment lever 70 may be adjustable in any suitable way, for example by a sliding mechanism.

By adjusting the pivot position of the adjustment lever 70, the resistance provided by the device 10 can be increased or decreased as desired. This is because adjusting the pivot position of the adjustment lever 70 changes the length of the adjustment lever 70 either side of the pivot. If the adjustment lever 70 has a length x and the distance from one end of the adjustment lever 70 to the pivot position is y, the lever ratio is defined as $y/(x-y)$. As such, by changing the pivot position, the distance y and the lever ratio can be changed without changing the length of the adjustment lever. There is therefore no requirement for an extendible or retractable lever arm that may not always be used. This allows for a compact design that still can still provide a wide range of resistance against movement of the chin receiving means 30 towards the exerciser body 20.

Each pivot position may increase or decrease the resistance with respect to an adjacent position by a set amount. For example, when the adjustment pin 75 is in a minimum resistance position closest to the exercising means 50, the resistance may be of the order of 20N. Each consecutive pivot position may increase the resistance by around 20N, until a maximum resistance position furthest from the exercising means 50, where the resistance may be of the order of 160N.

Figure 5B:
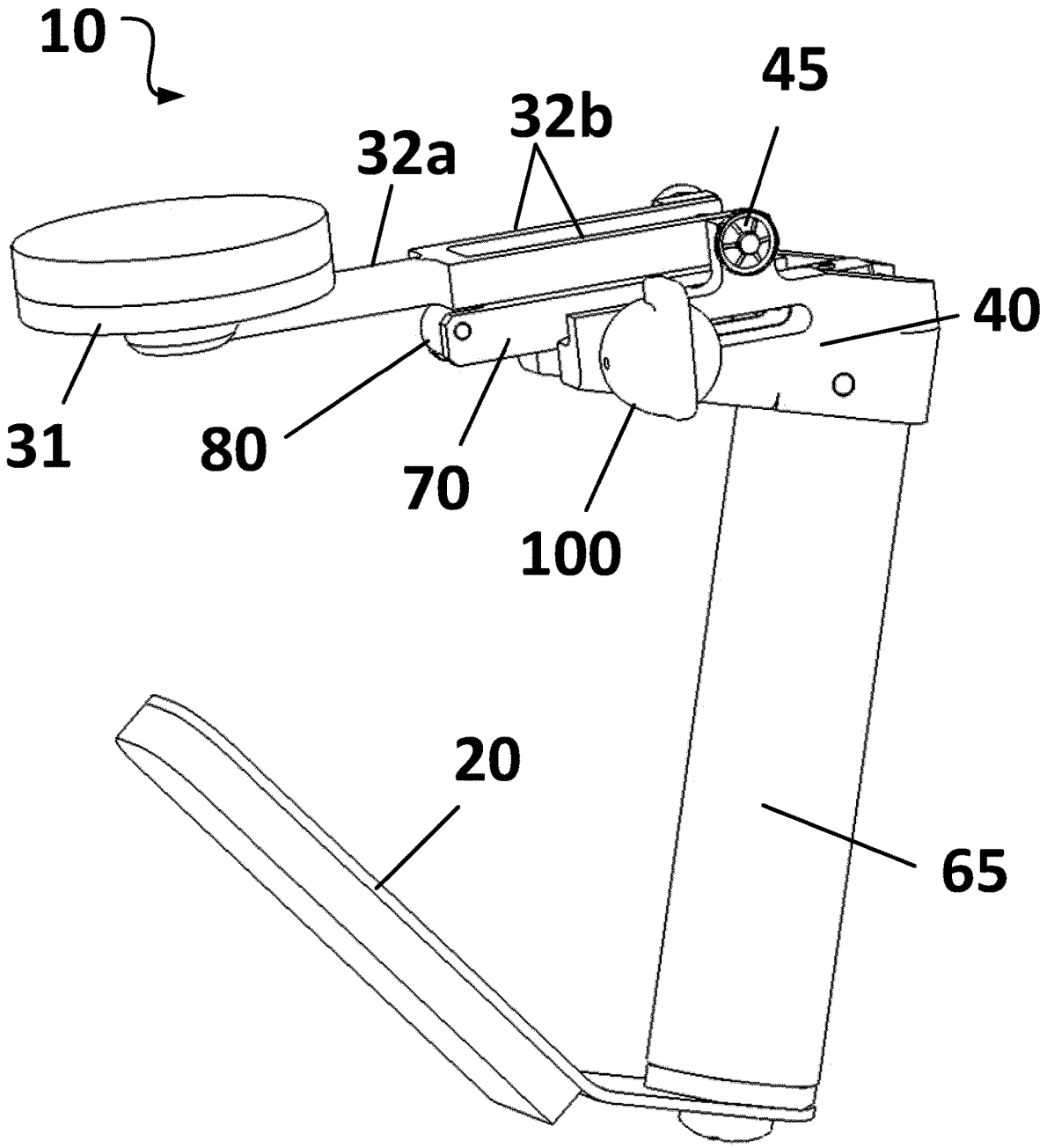
FIG. 5*b* is a perspective view of an exercise device according to an embodiment of the present invention.

FIG. 5*b* shows a perspective view of the exercise device according to this embodiment. As shown in FIG. 5*b*, the holding means 40 connects the chin receiving means 30 to the exerciser body 20 via the pin 45. The holding means 40 also connects the adjustment lever 70 to the exerciser body 20 via the adjustment pin 75

As also shown in FIG. 5*b*, an adjustment knob 100 is present which enables movement of the adjustment pin 75 between the positions in the rack 95. The adjustment knob 100 can be turned to an open position to enable movement of the adjustment pin 75 between the pivot positions. The adjustment knob 100 can then be turned to a closed position to lock the adjustment pin 75 in place.

FIG. 5*b* also shows that the connection member 32 of the chin receiving means 30 has a forked structure at one end. That is to say, the connection member 32 comprises a single arm 32*a* that connects to the chin receiving plate 31 and two parallel arms 32*b* connected to the pin 45. This structure allows one end of the adjustment lever 70 to pass between the arms 32*b* when the adjustment lever 70 pivots about the adjustment pin 75. This will be discussed in relation to FIG. 5*c*.

Figure 5C:
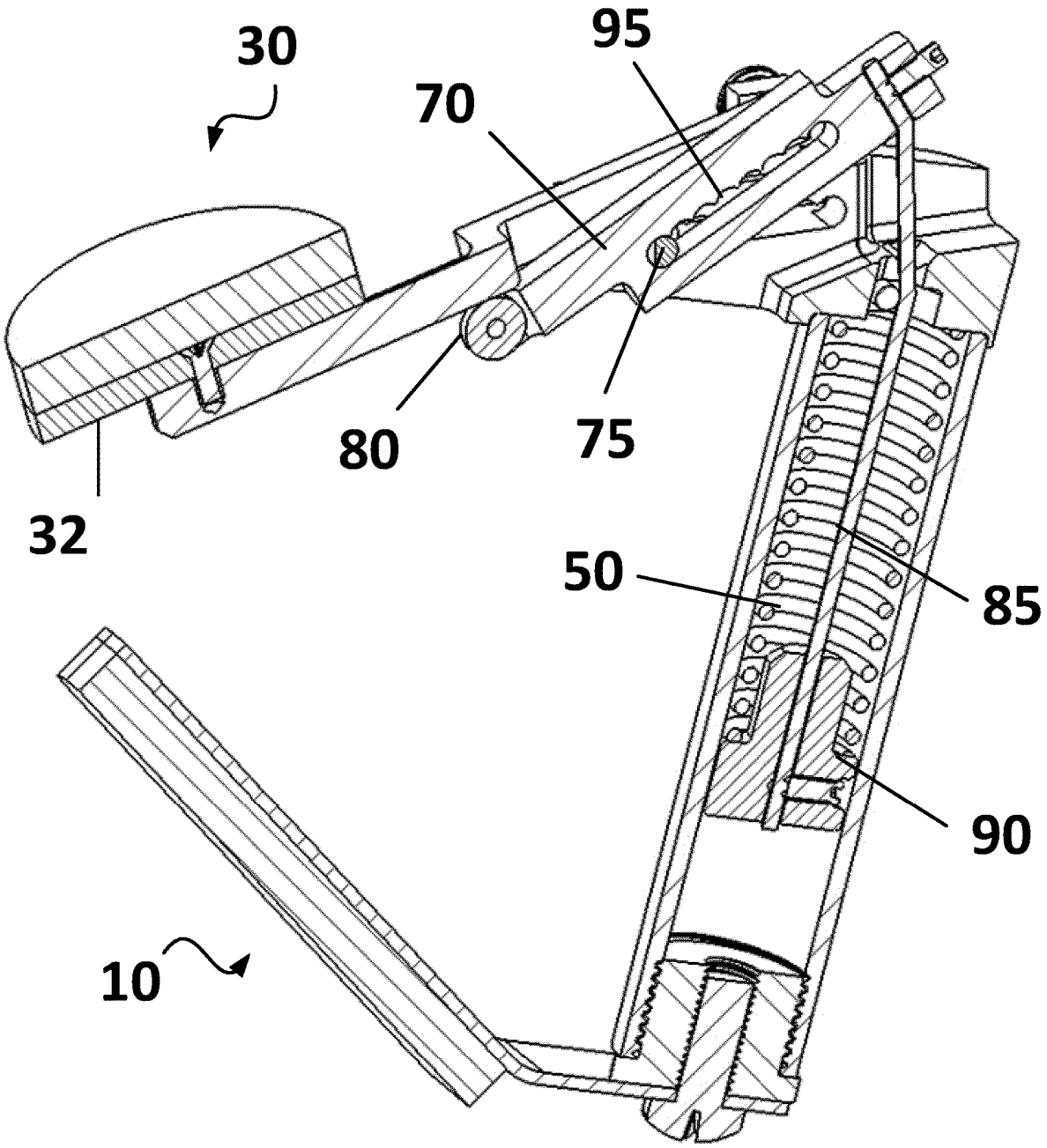
FIG. 5*c* is a perspective cross-sectional view of an exercise device according to an embodiment of the present invention.

FIG. 5*c* shows a cross-sectional view of the previously described embodiment in use. When the user pushes their chin downwards, i.e. towards the chest, the chin receiving means 30 will pivot about the pin 45. This causes the roller 80 to move along the lower surface of the arm 32*a* of the connection member 32, which in turn causes the adjustment lever 70 to pivot in an anticlockwise sense about the adjustment pin 75. In turn, an end of the adjustment lever 70 passes upwards between the arms 32*b* of the chin receiving means 30, and pulls the connecting element 85 and the stop 90 upwards. This causes compression of the exercising means 50, which provides resistance against the user pushing their chin downwards. As such, the user can perform the exercises discussed above to exercise the relevant muscles. As discussed above, the resistance of the exercise device 10 can be adjusted by changing the position of the adjustment pin 75.

In some examples, the exercising means 50 may comprise a plurality of springs, which may each be individually activated. The plurality of springs may be arranged in a magazine arrangement. Each spring may have an individual resistance, and a maximum resistance may be dependent on the number of springs used. For example, the spring magazine may comprise eight springs each having a 20 N resistance. Due to the individual activation of the springs, a resistance range of 20N to 160 N can be achieved.

Figure 6:
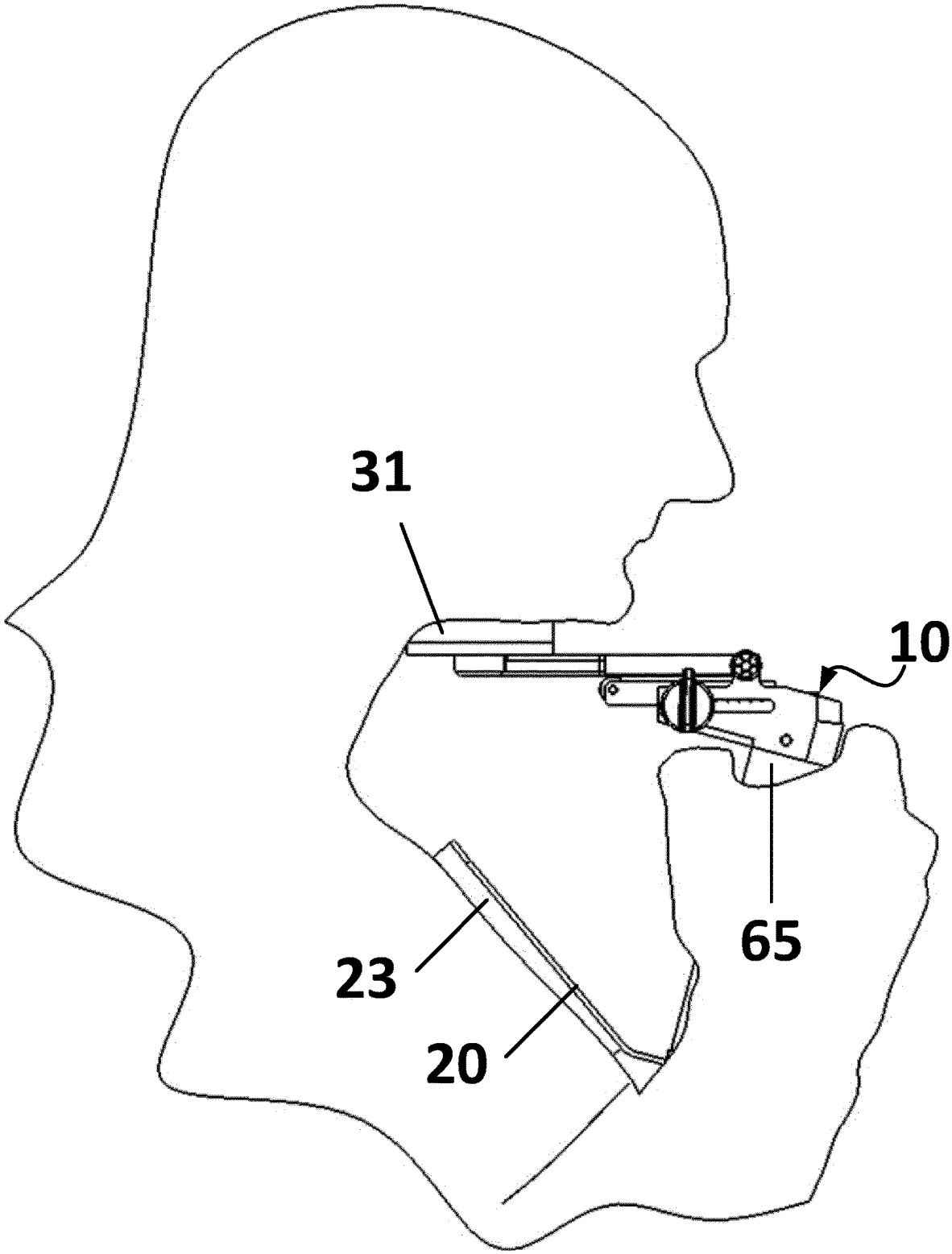
FIG. 6 illustrates an exercise device according to an embodiment of the present invention in use.

FIG. 6 illustrates the exercise device 10 in use. In FIG. 6, the user holds the exerciser device 10 in a start position, i.e. before any swallowing rehabilitation has begun. The user holds the handle 65 during use. As seen in FIG. 6, the chest resting plate 23 of the exerciser body 20 rests against the chest of the user and the user's chin is resting on the chin receiving plate 31 in the start position. The exercise device 10 may be used for a plurality of different exercises starting from this start position.

Although the present invention has been described above with reference to specific embodiments, it is not intended to be limited to the specific form set forth herein. Rather, the invention is limited only by the accompanying claims and, other embodiments than the specific above are equally possible within the scope of these appended claims.

In the claims, the term "comprises/comprising" does not exclude the presence of other elements or steps. Furthermore, although individually listed, a plurality of means, elements or method steps may be implemented by e.g. a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc. do not preclude a plurality. Reference signs in the claims are provided merely as a clarifying example and shall not be construed as limiting the scope of the claims in any way.

The invention claimed is:

1. A device for rehabilitation of swallowing, the device comprising:

a body comprising a chest plate;

a handle coupled to the chest plate;

a holder fixed relative to the handle;

a chin rest movably coupled to the holder; and a bias member coupled to the body and adapted to provide resistance when the chin rest is displaced toward the chest plate, wherein the chin rest comprises a lever arm pivotally coupled to the holder and the bias member is disposed between the body and the lever arm.

2. The device of claim 1, wherein the bias member is coupled to the lever arm and disposed within the handle.

3. The device of claim 2, wherein the lever arm comprises a roller and the chin rest moves relative to the roller when the chin rest is displaced toward the chest plate.

4. The device of claim 2, wherein the lever arm is coupled to the body by a fulcrum, and the fulcrum provides an adjustable and variable resistance for displacement of the chin rest toward the chest plate.

5. The device of claim 4, wherein the fulcrum is movable to different positions along the lever arm to adjust the resistance of the bias member.

6. The device of claim 4, wherein the lever arm comprises a rack and the fulcrum is movable to different positions within the rack of the lever arm to adjust the resistance of the bias member.

7. The device of claim 1, wherein the holder comprises a guide track and the bias member is coupled between the body and the chin rest to provide resistance when the chin rest is displaced toward the chest plate and restrained within the guide track.

8. The device of claim 1, wherein the chin rest includes padding.

9. The device of claim 1, wherein the bias member is one of a spring and an elastomer.

10. The device of claim 1, wherein an elongated slot is formed in the body and the bias member is coupled with the elongated slot of the body, and where a position of the bias member relative to the holder is adjustable by moving the bias member relative to the elongated slot to provide an adjustable and variable resistance for displacement of the chin rest toward the chest plate.

11. The device of claim 1, wherein a length of the bias member is adjustable to provide an adjustable and variable resistance for displacement of the chin rest toward the chest plate.

12. The device of claim 1, wherein the body further comprises a support that is connected between the chest plate and the handle to form a closed loop.

13. The device of claim 1, wherein the lever arm is coupled to the holder by a pin to allow the lever arm to pivot relative to the holder, and the bias member is coupled on a first end to the lever arm and at a second end to a stopper that is disposed within the handle;

wherein stopper moves within the handle to compress the bias member when the lever arm pivots relative to the pin.

14. A device for rehabilitation of swallowing, the device comprising:

a body comprising a chest plate;

a handle coupled to the chest plate;

a holder fixed relative to the handle;

a chin rest movably coupled to the holder; and a bias member coupled to the body and adapted to provide resistance in response to displacement of the chin rest relative to the chest plate;

wherein an elongated slot is formed in the body and the bias member is coupled with the elongated slot of the body, and where a position of the bias member relative to the holder is adjustable by moving the bias member relative to the elongated slot to provide an adjustable and variable resistance for displacement of the chin rest toward the chest plate to allow strengthening muscles of the tongue and neck.

15. A device for rehabilitation of swallowing, the device comprising:

a body comprising a chest plate;

a handle coupled to the chest plate;

a holder fixed relative to the handle;

a chin rest movably coupled to the holder; and a bias member coupled to the body and adapted to provide resistance when the chin rest is displaced toward the chest plate;

wherein the chin rest is movably coupled to the holder by a lever arm pivotally coupled to the holder and the bias member is coupled to the lever arm and disposed within the handle.

16. The device of claim 15, wherein the lever arm is coupled to the body by a fulcrum, and the fulcrum provides an adjustable and variable resistance for displacement of the chin rest toward the chest plate.

17. The device of claim 16, wherein the fulcrum is movable to different positions along the lever arm to adjust the resistance of the bias member.

18. The device of claim 16, wherein the lever arm comprises a rack and the fulcrum is movable to different positions within the rack of the lever arm to adjust the resistance of the bias member.

19. The device of claim 15, wherein the lever arm comprises a roller and the chin rest moves relative to the roller when the chin rest is displaced toward the chest plate.

20. A device for rehabilitation of swallowing, the device comprising:

a body comprising a chest plate;

a handle coupled to the chest plate;

a holder fixed relative to the handle;

a chin rest movably coupled to the holder; and a bias member coupled to the body and adapted to provide resistance when the chin rest is displaced toward the chest plate;

wherein the body further comprises a support that is connected between the chest plate and the handle to form a closed loop.

* * * * *